United States Patent [19]

Lynch et al.

[11] 4,160,942

[45] Jul. 10, 1979

[54] GOLF BALL TRAJECTORY PRESENTATION SYSTEM

[75] Inventors: Francis deS. Lynch, Mattapoisett; William Gobush, North Darmouth; Paul F. Sullivan; Randall W. Moore, both of Acushnet; Steven L. Haas, Marion; Norman O. Fonteneau, Acushnet; John W. Jepson, Marion, all of Mass.

[73] Assignee: Acushnet Company, New Bedford, Mass.

[21] Appl. No.: 832,379

[22] Filed: Sep. 12, 1977

[51] Int. Cl.[2] ..... G03B 21/56; A63B 69/36

[52] U.S. Cl. ..... 350/120; 35/29 A; 273/183 R; 273/184 R; 273/185 A

[58] Field of Search ..... 352/39, 84; 350/117, 350/120; 354/60, 132, 120; 35/29 A; 273/177 A, 177 B, 181 B, 181 E, 184 R, 185 A, 183 R

[56] References Cited

U.S. PATENT DOCUMENTS

| | | | |
|---|---|---|---|
| 3,469,905 | 9/1969 | Baldwin et al. | 352/39 |
| 3,589,732 | 6/1971 | Ressell et al. | 273/185 A |
| 3,598,976 | 8/1971 | Russell et al. | 273/183 R |

*Primary Examiner*—Richard A. Wintercorn

*Attorney, Agent, or Firm*—Eyre, Mann, Lucas & Just

[57] ABSTRACT

A trajectory calculator receiving data indicating initial values of golf ball flight angle, velocity and spin, calculates the apparent elevation and deflection angles at which the golf ball would be seen by an observer at the launch point. An optical object projector projects an image representing the golf ball on a screen. The size of the image decreases with time to yield the apparent perspective size decrease with range. An optional exerciser console enables input of changeable environmental quantities.

5 Claims, 2 Drawing Figures

GOLF BALL TRAJECTORY PRESENTATION SYSTEM

BACKGROUND OF THE INVENTION

A teaching center for golfers in which the golfer drives a golf ball in an instrumented range has been developed. Data is collected on the performance of the golfer's body, swing of the golf club, and initial flight of the ball.

SUMMARY OF THE INVENTION

The instant invention teaches a system for calculating the trajectory a golf ball would follow when driven according to the measured initial flight parameters and for projecting a spot of light on a screen in such a manner that is accurately simulates the appearance of a golf ball in flight from the viewing point occupied by the golfer. The initial flight parameters of the golf ball, i.e. rate and direction of displacement, rate of rotation and axis of rotation are obtained in real time. The effect of these factors on a golf ball is described in application Ser. No. 626,712 filed Oct. 29, 1975, now U.S. Pat. No. 4,063,259 issued Dec. 13, 1977, and owned by the assignee of the instant invention. These are then converted to spot projection which appears on a projection screen. In accordance with the present invention, the place of the real driven golf ball is taken by the projected image and the apparent arc of flight of the golf ball is projected. As with real golf balls, the apparent size of the golf ball decreases until its flight is interrupted by apparent impact with the ground, bounce and roll.

An optional exerciser is capable of inserting environmental problem variables such as wind and ground softness. In addition, the exerciser may insert traps and water hazards having infinite softness, and various obstructions to flight. If the ball lands in an area of infinite softness its travel is immediately stopped with no roll. In the case of landing in a water hazard, the ball may be made to disappear. If the ball contacts an obstruction, it may rebound or fall to the ground in realistic imitation of the true performance of the ball.

DETAILED DISCLOSURE OF THE PREFERRED EMBODIMENT

Figure 1:
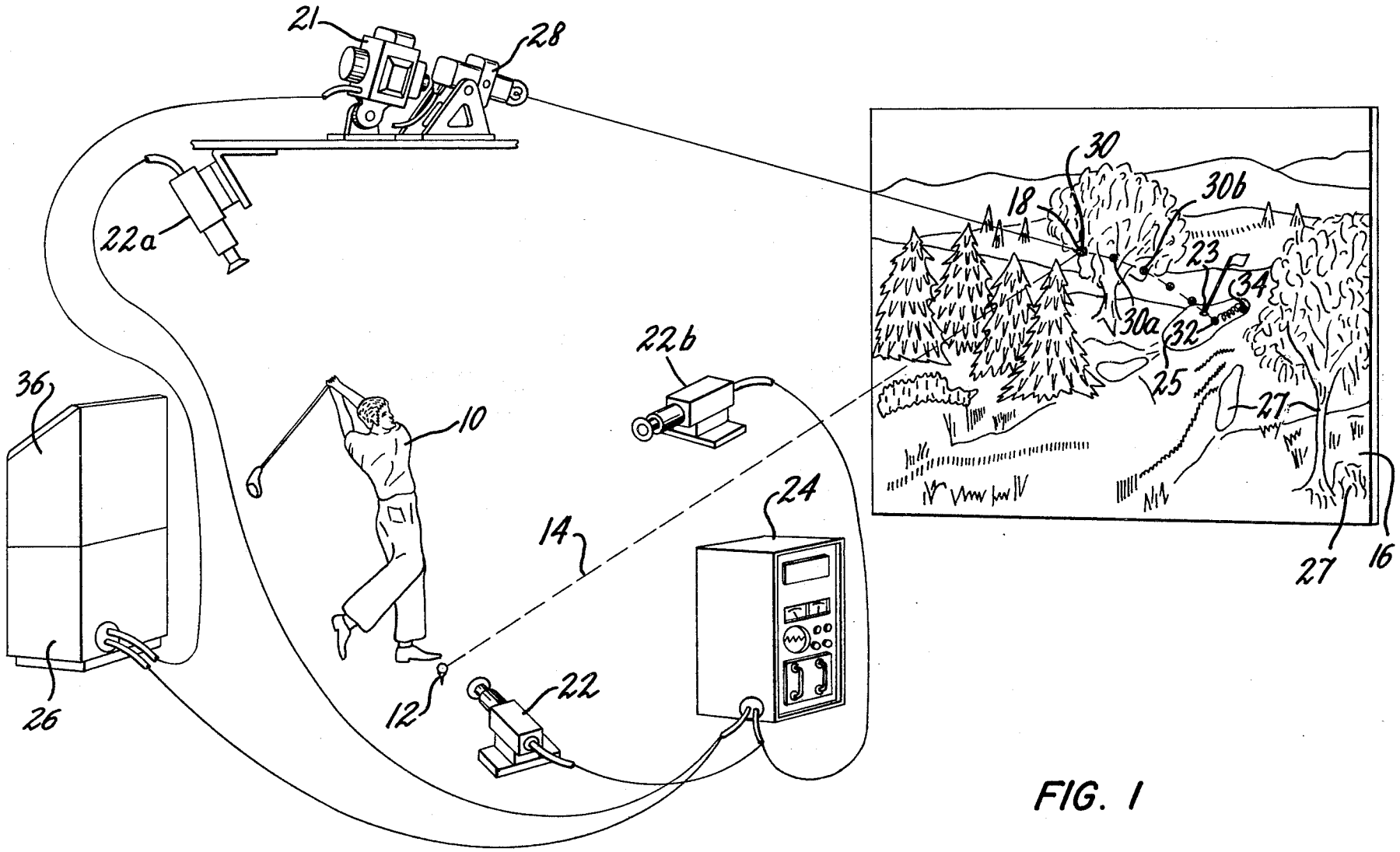
FIG. 1 shows an overall pictorial view of the invention.

A golfer 10 is shown in his follow-through after having driven a golf ball from a tee 12 along the dashed line shown at 14 toward screen 16.

A selected golf fairway scene (not completely shown) is projected on the screen by a projector 21. The projected fairway scene may advantageously contain an aiming point such as a golf flag 23 on a golf green 25 and a variety of hazards 27 such as sand traps, trees, rocks and bodies of water.

The initial flight of the ball is monitored by a launch monitor system to give initial flight conditions of displacement and rotation. Suitable apparatus for accomplishing this is known to those of ordinary skill in the art.

Electro optical sensors 22, **22*a*, 22*b* are suitably used for measurement and are cabled to a launch monitor 24** which calculates the initial flight conditions of initial velocity, launch angle and initial spin of the golf ball. The initial flight conditions are connected to a trajectory calculator 26 which calculates a flight trajectory. The flight trajectory is converted to values of elevation angle $\phi$ and deflection angle $\theta$ of the ball as it would be seen by the golfer 10. The calculated angular values are connected to a ball projector 28 which follows these angles. In addition to the angular values, the trajectory calculator may also calculate the time at which the golf ball impacts the screen 16 at 18. At or near the time of impact of the ball with the screen, the ball projector 28 is turned on. The projected spot 30 appears at the point of impact 18 and at approximately the same size as the golf ball. As the ball projector 28 is driven by additional calculated values of $\theta$ and $\phi$, the projected spot 30 moves smoothly along an apparent arc shown in the figure by a succession of spots **30*a*, 30*b*, etc., until the ball contacts the ground at 32, bounces and rolls realistically before coming to rest at 34**.

An exerciser console 36 may optionally be included to enable application of environmental and other variables to the flight, bounce and roll of the ball by the instructor. Environmental variables can include humidity, temperature, atmospheric pressure, wind, ground softness and terrain slope. In addition, the exerciser console 36 may be able to add or subtract hazards 27 and to modify their effect. For example, the exerciser console may make the sand trap 27 effective or ineffective to retard the progress of a ball driven into it according to the degree of difficulty which the instructor wishes to impose on the golfer's play.

Figure 2:
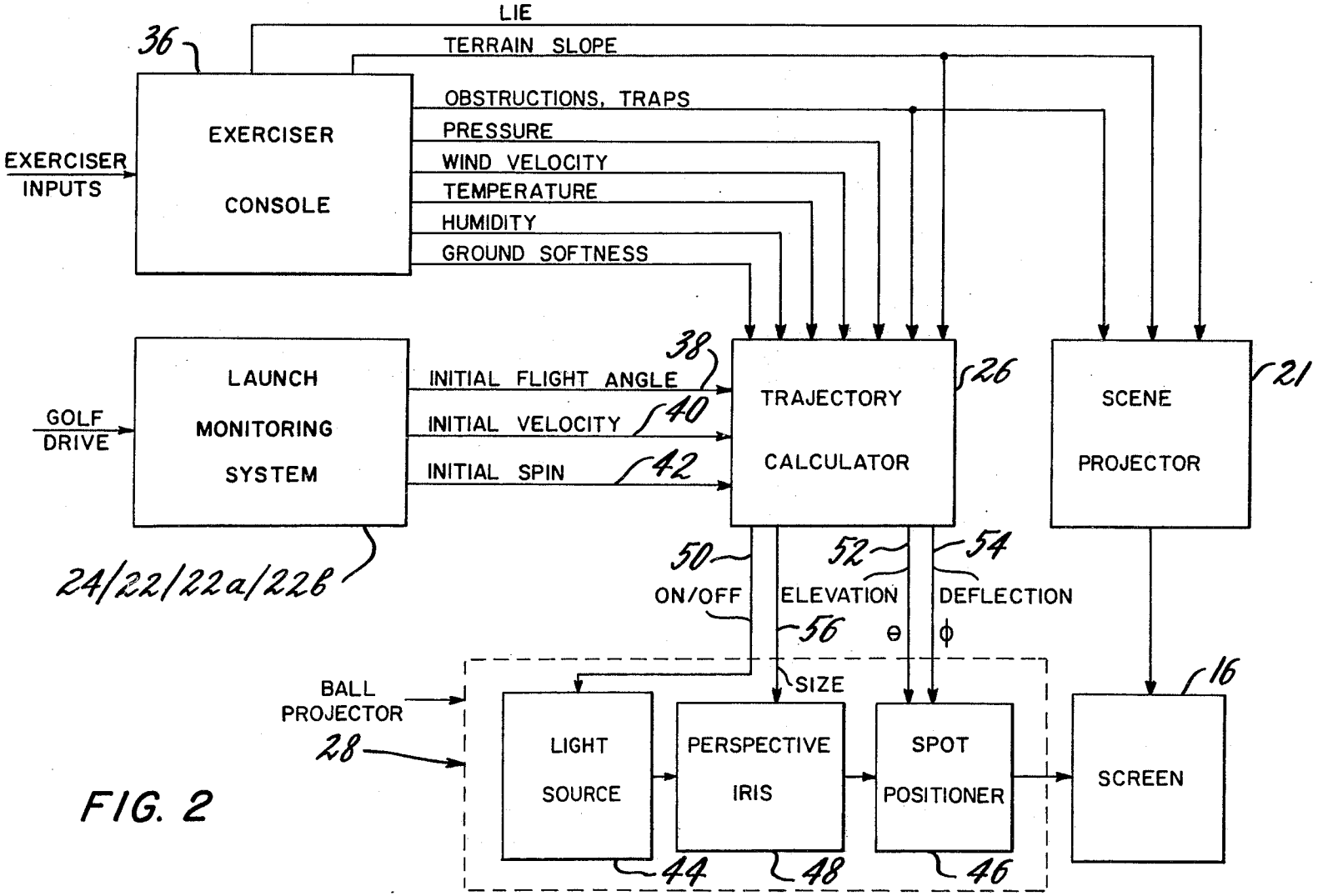
FIG. 2 is a block diagram showing the interconnections of the various measuring means, calculating means, projector, etc.

Referring now to FIG. 2, the block diagram shows the interconnections of the units previously described. The launch monitor system, made up of elements 24, 22, **22*a* and 22*b* previously described, measures the parameters of early flight and connects signals indicative of flight launch angle 38, initial velocity 40 and initial spin velocity 42 to the trajectory calculator 26. The trajectory calculator 26 may be an electro-mechanical device, receiving electrical inputs and generating mechanical outputs; an analog device receiving analog or digital electrical inputs, performing analog calculations, and generating analog or digital electrical outputs; or it may be a digital device receiving digital or analog inputs, performing digital calculations, and generating analog or digital electrical outputs. Where digital outputs are produced by the trajectory calculator 26, digital to analog conversion of the output signals will ordinarily be needed before use in the using circuit. A digital form of the trajectory calculator 26** is preferred for its greater accuracy and flexible adaptiviness to changing requirements.

The ball projector 28 contains a light source 44, including optics, and a spot positioner 46. In addition, a perspective iris 48 is optionally and preferably interposed between the light source 44 and the spot positioner 46.

The light source 44 is turned on at the correct time by an ON/OFF signal 50 from the trajectory calculator 26. The turn-on may be accomplished by applying electrical power to a previously unpowered lamp (not shown), but turn-on by unshuttering of a continuously illuminated lamp is preferred in order to avoid lamp start-up delay. The spot positioner 46 responds to elevation 52 and deflection commands 54 to position the spot at the correct bi-angular position on the screen 16.

The perspective iris 48 varies its diameter to change the size of the spot on the screen 16. A size signal 56 causes the spot diameter on the screen 16 to decrease from the actual diameter of a golf ball at the instant of screen penetration to a range diminished smaller value by the time it lands and rolls to a stop. The desired diameter of the spot D can be given as:

$$\frac{D_{ri}}{R/_{Rl}}$$

Where:

R—range from golfer to ball;

$D_{ri}$—diameter of ball at range R1

R1—reference range

The reference range R1 can conveniently be taken as the range from golfer 10 to screen 16. At that range, the projected spot diameter D should equal the actual ball diameter $D_B$.

If a ball were to travel in a straight line at a constant velocity, the rate of change of diameter with respect to time would be a constant.

$$dD/dt = \text{constant}$$

In fact, however, the flight of the ball is neither constant velocity nor straight, but instead is a slowing curved trajectory. Thus, precise duplication of the perspective size change would require a time function.

$$dD/dt = f(t)$$

From a practical standpoint, it is doubtful whether a human observer of normal visual acuity could detect the difference between a properly chosen constant perspective size change and one using a precisely correct time function. Thus a constant perspective command in signal 56 to the perspective iris 48 is preferred due to its simplicity.

The size signal 56 may optionally be simplified even further by assuming that all golfers drive a golf ball at the same velocity. This assumption allows a single perspective size change rate for all golfers. With this simplification, the size signal 56 may be an on-off electrical signal which drives a constant speed electric motor in the perspective iris 48 during its on time.

The spot positioner 46 positions the spot on the screen 16 in elevation and deflection according to position command signals 52 and 54 respectively from the trajectory calculator 26.

The exerciser console 36 optionally provides means for inserting environmental variables to the trajectory calculator 26 and the scene projector 21. The scene projector 21 may consist of one or more optical projectors each having the ability to select from one or more optical slides.

Other means of creating images may be substituted for the scene projector 21 and ball projector 28 without departing from the spirit of this invention. For example, a cathode ray tube image generator of either projection or direct viewing type may be used to produce the images. If cathode ray tube scene generation is used, the insertion of the ball spot and terrain hazards may be performed electronically or by multiple scenes combined by a special effects generator.

While the system described herein has made specific reference to a golf ball as the projectile and while this is the principal object of the present invention, it will be understood that the present system can also be used for measuring other projectiles such as baseballs, footballs, tennis balls and the like. It will, therefore, be understood that the claims are intended to cover all changes and modifications of the preferred embodiments of the invention, herein chosen for the purpose of illustration which do not constitute departures from the spirit and scope of the invention.

What is claimed is:

1. A golf ball trajectory presentation system comprising:

(a) a plurality of electro-optical sensors for simultaneously monitoring the initial values of velocity, launch angle and spin velocity of said golf ball;

(b) means for calculating at least a major portion of the remainder of the trajectory of said golf ball based on said monitored initial values;

(c) a projection screen;

(d) means for forming an image on said projection screen adapted to substitution for said golf ball; and (e) means for positioning said image according to the calculated trajectory of said golf ball.

2. The system as recited in claim 1 further comprising means for diminishing the size of said image as a linear function of time.

3. The system as recited in claim 1 further comprising means for varying inputs to said means for calculating.

4. The system recited in claim 1 wherein the image forming means is an optical image projector.

5. The system recited in claim 1 further comprising means for varying said means for calculating whereby said remainder of the trajectory may be altered to simulate the inclusion of environmental conditions.

* * * * *